US006269646B1

(12) United States Patent
Lovett et al.

(10) Patent No.: US 6,269,646 B1
(45) Date of Patent: Aug. 7, 2001

(54) COMBUSTORS WITH IMPROVED DYNAMICS

(75) Inventors: Jeffery Allan Lovett, Jupiter, FL (US); Masayoshi Kuwata, Ballston Lake, NY (US); Anil Gulati, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/014,952

(22) Filed: Jan. 28, 1998

(51) Int. Cl.[7] ..... F02C 7/228; F23R 3/14; F23R 3/20

(52) U.S. Cl. ..... 60/737; 60/725; 60/747; 60/748; 431/114

(58) Field of Search ..... 60/39.06, 725, 60/737, 747, 748; 431/1, 114

(56) References Cited

U.S. PATENT DOCUMENTS

| | | | | |
|---|---|---|---|---|
| 2,573,536 | | 10/1951 | Bodine, Jr. . | |
| 2,796,734 | | 6/1957 | Bodine, Jr. . | |
| 3,034,299 | | 5/1962 | Hammet . | |
| 4,175,380 | | 11/1979 | Baycura . | |
| 4,265,615 | | 5/1981 | Lohmann et al. . | |
| 4,409,787 | | 10/1983 | Davi et al. . | |
| 4,677,822 | * | 7/1987 | Iizuka et al. | 60/747 |
| 4,761,958 | | 8/1988 | Hellat . | |
| 5,165,241 | | 11/1992 | Joshi et al. . | |
| 5,211,004 | | 5/1993 | Black . | |
| 5,218,824 | | 6/1993 | Cederwall et al. . | |
| 5,309,710 | * | 5/1994 | Corr, II | 60/39.23 |
| 5,323,614 | * | 6/1994 | Tsukahara et al. | 60/737 |
| 5,339,635 | * | 8/1994 | Iwai et al. | 60/737 |
| 5,408,830 | * | 4/1995 | Lovett | 60/737 |
| 5,471,840 | * | 12/1995 | Lovett | 60/737 |
| 5,551,228 | * | 9/1996 | Mick et al. | 60/39.06 |
| 5,943,866 | * | 8/1999 | Lovett et al. | 60/737 |

* cited by examiner

*Primary Examiner*—Ted Kim
(74) *Attorney, Agent, or Firm*—Patrick K. Patnode; Donald S. Ingraham

(57) ABSTRACT

A combustor comprises an outer combustor casing defining a plurality of circumferentially adjoining combustion chambers. Each combustion chamber comprises a dome at an upstream end and an outlet at a downstream end. A plurality of pre-mixers are joined to the combustor dome of each respective combustion chamber. The pre-mixers comprise a duct having an inlet at one end for receiving compressed air, an outlet at an opposite end disposed in flow communication with the combustion chamber and a swirler disposed in the duct adjacent the duct inlet for swirling air channeled therethrough. A fuel injector is provided for injecting fuel into the pre-mixer ducts and for mixing with the air in the ducts for flow into the combustion chamber to generate a combustion flame at the duct outlets. A portion of the pre-mixers comprise an altered flameholding capability so as to distribute the resulting combustion flames from the respective portion of the pre-mixers axially downstream with respect to the non-altered pre-mixers so as to reduce the dynamic pressure amplitude of the combustion flames.

6 Claims, 5 Drawing Sheets

COMBUSTORS WITH IMPROVED DYNAMICS

BACKGROUND OF THE INVENTION

The present invention relates generally to industrial turbine engines, and more specifically, to combustors therein.

Industrial power generation gas turbine engines include a compressor for compressing air that is mixed with fuel and ignited in a combustor for generating combustion gases. The combustion gases flow to a turbine that extracts energy for driving a shaft to power the compressor and produces output power for powering an electrical generator, for example. The turbine is typically operated for extended periods of time at a relatively high base load for powering the generator to produce electrical power to a utility grid, for example. Exhaust emissions from the combustion gases are therefore a concern and are subjected to mandated limits.

More specifically, industrial gas turbine engines typically include a combustor design for low exhaust emissions operation, and in particular for low NOx operation. Low NOx combustors are typically in the form of a plurality of burner cans circumferentially adjoining each other around the circumference of the engine, each burner can having a plurality of premixers joined to the upstream end.

Lean-premixed low NOx combustors are more susceptible to combustion instability in the combustion chamber as represented by dynamic pressure oscillations in the combustion chamber. The pressure oscillations, if excited, can cause undesirably large acoustic noise and accelerated high cycle fatigue damage to the combustor. The pressure oscillations can occur at various fundamental or predominant resonant frequencies and other higher order harmonics.

Such combustion instabilities may be reduced by introducing asymmetry in the heat release or for example by axially distributing or spreading out the heat release. One current method commonly used to introduce asymmetry for reducing combustion oscillations is to bias fuel to one or more burners generating more local heat release. Although this fuel-biasing method has been shown to reduce combustion instabilities, NOx emissions are substantially increased by the higher temperatures generated. Distributing the flame axially has been accomplished by physically offsetting one or more fuel injectors within the combustion chamber. A drawback to this offset approach, however, is that the extended surface associated with the downstream injectors must be actively cooled to be protected from the upstream flame. This additional cooling air has a corresponding NOx emissions penalty for the system.

Therefore, it is apparent from the above that there is a need in the art for improvements in combustor dynamics.

SUMMARY OF THE INVENTION

A combustor comprises an outer combustor casing defining a plurality of circumferentially adjoining combustion chambers. Each combustion chamber comprises a dome at an upstream end and an outlet at a downstream end. A plurality of pre-mixers are joined to the combustor dome of each respective combustion chamber. The pre-mixers comprise a duct having an inlet at one end for receiving compressed air, an outlet at an opposite end disposed in flow communication with the combustion chamber and a swirler disposed in the duct adjacent the duct inlet for swirling air channeled therethrough. A fuel injector is provided for injecting fuel into the pre-mixer ducts for mixing with the air in the ducts for flow into the combustion chamber to generate a combustion flame at the duct outlets. A portion of the pre-mixers comprise an altered flameholding capability so as to distribute the resulting combustion flames from the respective portion of the pre-mixers axially downstream with respect to the non-altered pre-mixers so as to reduce the dynamic pressure amplitude of the combustion flames.

DETAILED DESCRIPTION OF THE INVENTION

Figure 1:
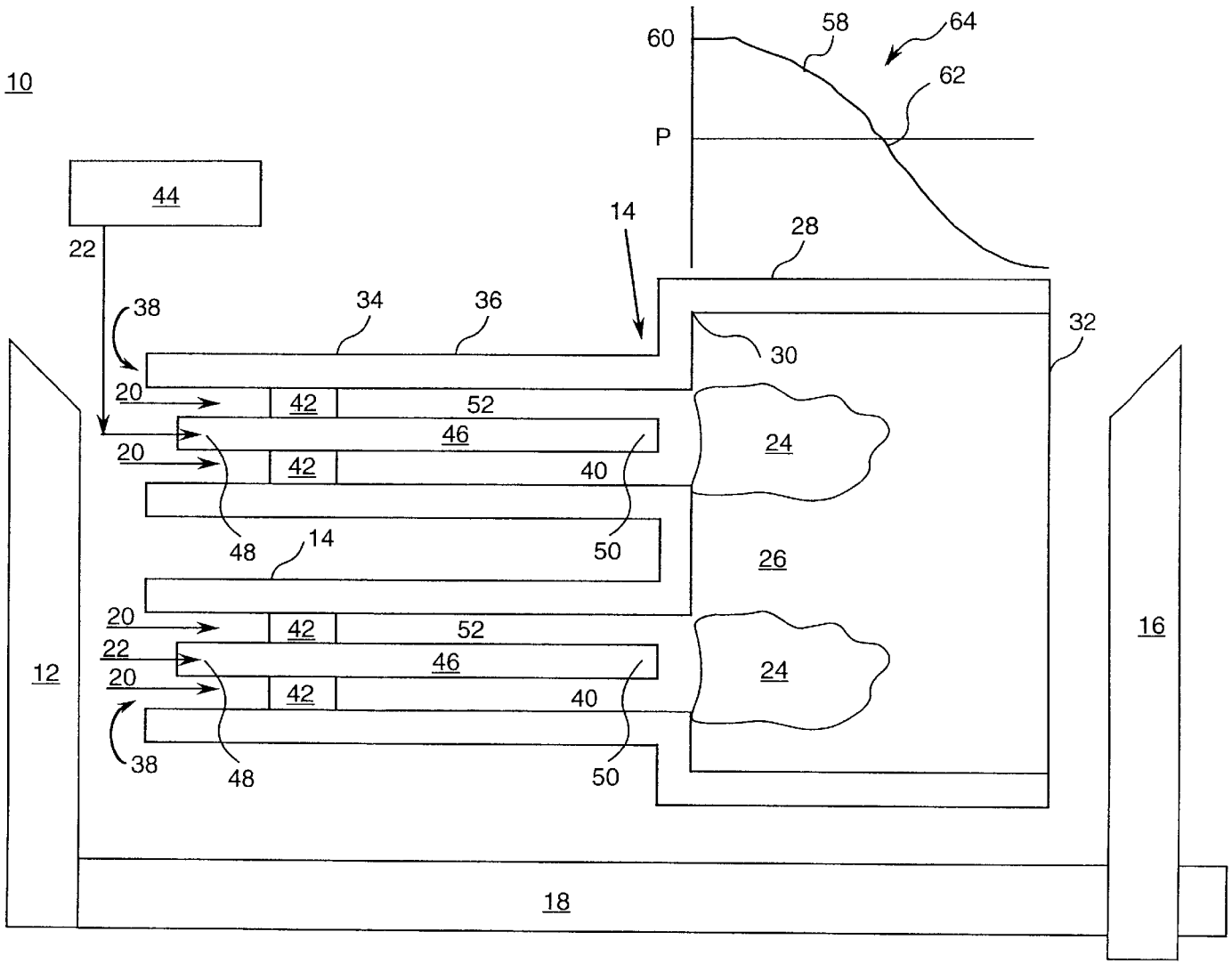
FIG. 1 (PRIOR ART)
FIG. 1 is a schematic representation of a representative industrial gas turbine engine having a low NOx combustor joined in flow communication with a compressor and turbine.

An industrial turbine engine 10 having a compressor 12 disposed in serial flow communication with a low NOx combustor 14 and a single or multistage turbine 16 is shown in FIG. 1. Turbine 16 is coupled to compressor 12 by a drive shaft 18, a portion of which drive shaft 18 extends therefrom for powering an electrical generator (not shown) for generating electrical power, for example. Compressor 12 charges compressed air 20 into combustor 14 wherein compressed air 20 is mixed with fuel 22 and ignited for generating combustion gases or flame 24 from which energy is extracted by turbine 16 for rotating shaft 18 to power compressor 12, as well as producing output power for driving the generator or other external load.

In this exemplary embodiment combustor 14 includes a plurality of circumferentially adjoining combustion chambers 26 each defined by a tubular combustion casing 28. Each combustion chamber 26 further includes a generally flat dome 30 at an upstream end thereof and an outlet 32 at a downstream end thereof. A conventional transition piece (not shown) joins the several outlets 32 to effect a common discharge to turbine 16.

Coupled to each combustion dome 30 are a plurality of premixers 34. Each premixer 34 includes a tubular duct 36 having an inlet 38 at an upstream end for receiving compressed air 20 from compressor 12 and an outlet 40 at an opposite, downstream end disposed in flow communication with combustion chamber 26 through a corresponding hole in dome 30. Dome 30 is typically larger in radial extent than the collective radial extent of the several premixers which allows premixer 34 to discharge into the larger volume defined by combustion chamber 26. Further, dome 30 provides a bluff body which acts as a flameholder from which combustion flame 24 typically extends downstream from during operation.

Each of premixers 34 preferably includes a swirler 42, which swirler 42 includes a plurality of circumferentially spaced apart vanes exposed in duct 36 adjacent to duct inlet 38 for swirling compressed air 20. A fuel injector 44 is provided for injecting fuel 22 such as a natural gas, into the several ducts 36 for mixing with swirled air 20 in ducts 36 for flow into combustion chamber 26 to generate combustion flame 24 at duct outlets 40.

In the exemplary embodiment illustrated in FIG. 1, each of premixers 34 further includes an elongate center body 46 disposed coaxially in duct 36, and having an upstream end 48 at duct inlet 38 joined to and extending through the center of swirler 42, and a bluff or flat downstream end 50 disposed at duct outlet 40. The center body 46 is spaced radially inwardly from duct 36 to define a cylindrical load channel 52 therebetween.

Fuel injector 44 may include conventional components such as a fuel reservoir, conduits, valves and any required pumps for channeling fuel 22 into the several center bodies 46.

In order to maintain suitable dynamic stability of combustor 14 during operation, the various frequencies of pressure oscillation should remain at relatively low pressure amplitudes to avoid resonance at unsuitably large pressure amplitudes leading to combustor instability expressed in a high level of acoustic noise or high cycle fatigue damage, or both. Combustor stability is conventionally effected by adding damping using a perforated combustion liner for absorbing the acoustic energy. This method, however, is undesirable in a low emissions combustor since the perforations channel film cooling air which locally quench the combustion gases thereby increasing the CO levels. Moreover, it is preferable to maximize the amount of air reaching the premixer for reduced NOx emissions.

Dynamic uncoupling may be better understood by understanding the apparent theory of operation of combustor dynamics as discussed in co-pending, commonly assigned, application Ser. No. 08/812,894 U.S. Pat. No. 5,943,866, entitled "Dynamically Uncoupled Low NOx Combustor," filed on Mar. 10, 1997, which application is herein incorporated by reference.

It has been shown that Rayleigh's criteria must be met for strong oscillations to grow in a pre-mixed combustion system. This criteria suggests that instabilities grow if fluctuations in heat release are in phase with the fluctuating acoustic pressure. Accordingly, combustion instabilities can be reduced if the heat release is controlled with respect to the acoustic pressures.

As shown in FIG. 1, premixer 34 includes a relatively narrow passage at duct outlet 40 to accelerate the flow of fuel 22 and air 20 into combustion chamber 26 so as to prevent flame propagation back into pre-mixer 34 (i.e., flashback). This relatively narrow duct outlet 40 of premixer 34 in combination with the choked turbine nozzle (not shown) at the exit of combustor 14 approximates an acoustic chamber having both ends nearly closed. For an acoustic chamber having both ends very nearly closed the fundamental longitudinal acoustic standing wave mode is a half wavelength. Accordingly, applying this approximation to combustion chamber 26, the half wavelength acoustic standing wave 58, as depicted in graph 60 has maximum fluctuations in pressure at dome end 30 of combustion chamber 26 and at outlet 32. Additionally, standing wave 58 further comprises a pressure node 62 having about zero fluctuating pressure at about the center of combustion chamber 26 as identified by reference line 64.

As shown in FIG. 1, flame structure 24 is typically stabilized and anchored at dome end 30 of combustion chamber 26. In this conventional configuration, flame structures 24 are all essentially concentrated in one axial position at dome end 30 of combustion chamber 26 in a region of maximum fluctuations in pressure (see graph 60). Accordingly, both the heat release (flame 24) and the maximum pressure fluctuation exist in dome end 30 of combustion chamber 26 maximizing Rayleigh's criteria and consequently maximizing the opportunity for coupling between the heat release and the pressure oscillation.

In accordance with the instant invention, combustor 14 is configured such that at least a portion of flame structures 24 are axially positioned at or near pressure node 62 where pressure fluctuations are significantly reduced. Because the pressure fluctuations are reduced with respect to at least a portion of the flame structures 24, Rayleigh's criteria is minimized and coupling between the pressure wave and the combustion wave is lessened.

Figure 2:
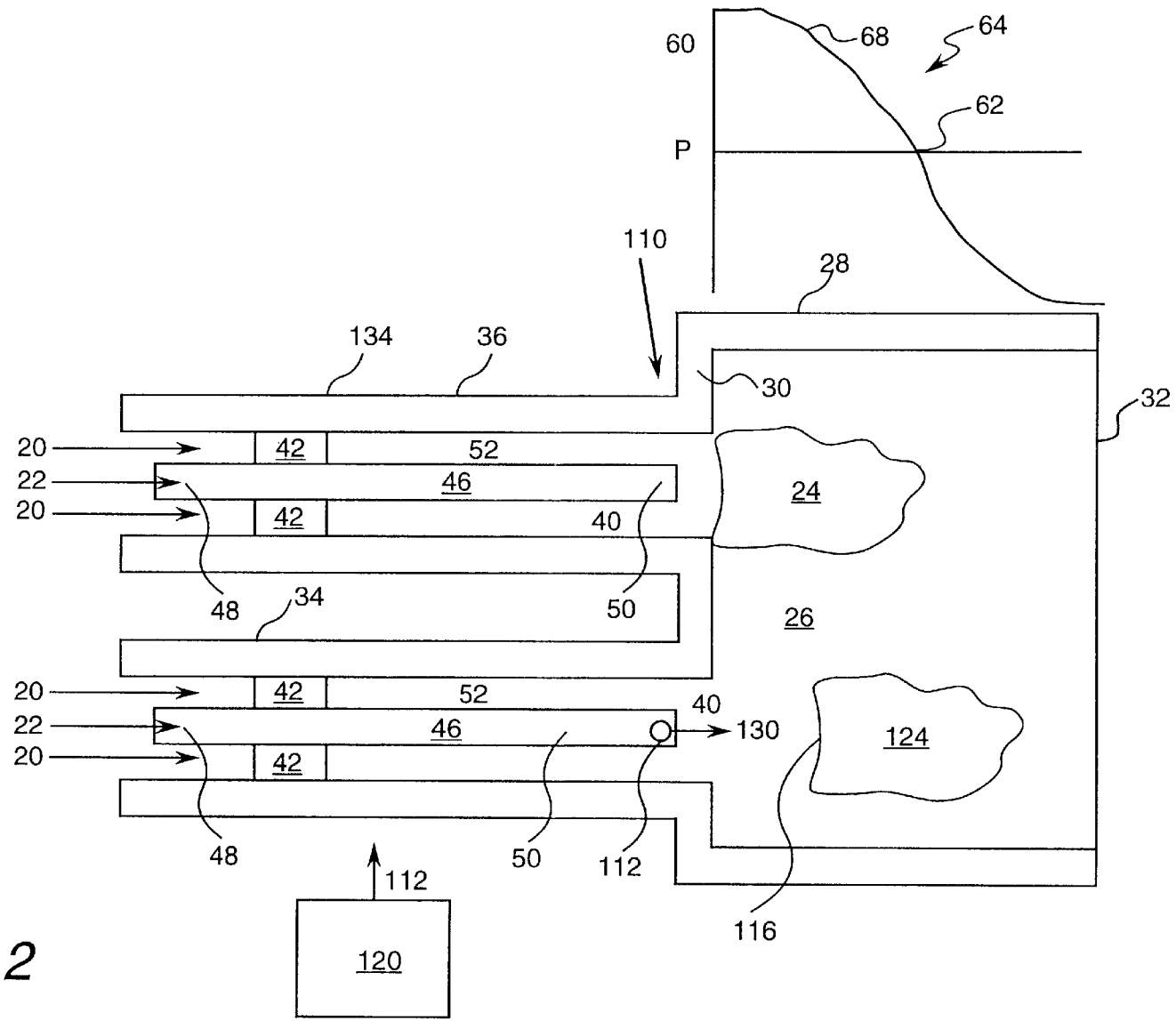
FIG. 2 is a schematic representation of a portion of an industrial gas turbine engine having a low NOx combustor in accordance with one embodiment of the present invention.

In accordance with one embodiment of the instant invention, combustor 110 is shown in FIG. 2. As shown in FIG. 2, flame structure asymmetry is introduced within combustor 110 by axial distribution of at least a portion of flame structures 124. Through this asymmetric distribution of flame structures 124, at least a portion of the combustion taking place within combustion chamber 26 will be axially positioned closer to pressure node 62 so as to decouple the heat release from flame structures 124 from the maximum pressure located at dome end 30.

In one embodiment of the instant invention, center body 46 further comprises at least one and typically a plurality of orifices 112 disposed within the downstream end 50 of a portion of pre-mixers 136 having axially distributed flame structures 124. High velocity air 130 is directed through orifices 112 so as to impinge upon a root portion 116 of the axially distributed flame structures 124 so as to lift flame structures 124 from the conventional anchoring location at downstream end 50 of center body 46 and at dome end 30 of combustion chamber 26 to an axial location downstream towards pressure node 62. The velocity of high velocity air 130 should be great enough to overcome the flame propagation speed. In one embodiment of the instant invention, high velocity air 130 is supplied directly to orifices 112 from a high pressure air source 120. In another embodiment of the instant invention, high velocity air 130 is supplied passively to orifices 112 by providing fluid communication between at least one orifice 112 and a high pressure region of turbine engine 10.

The velocity of high velocity air 130 supplied from high pressure air source 120 can be manipulating so as to "tune" combustion chamber 26 for minimum combustion instabilities. As the velocity of high velocity air 130 is manipulated, the corresponding flame structures 124 will be axially manipulated such that flame structures 124 are positioned closer to outlet 32 or alternatively closer to dome end 30 depending on which direction will stabilize combustor 110.

Figure 3:
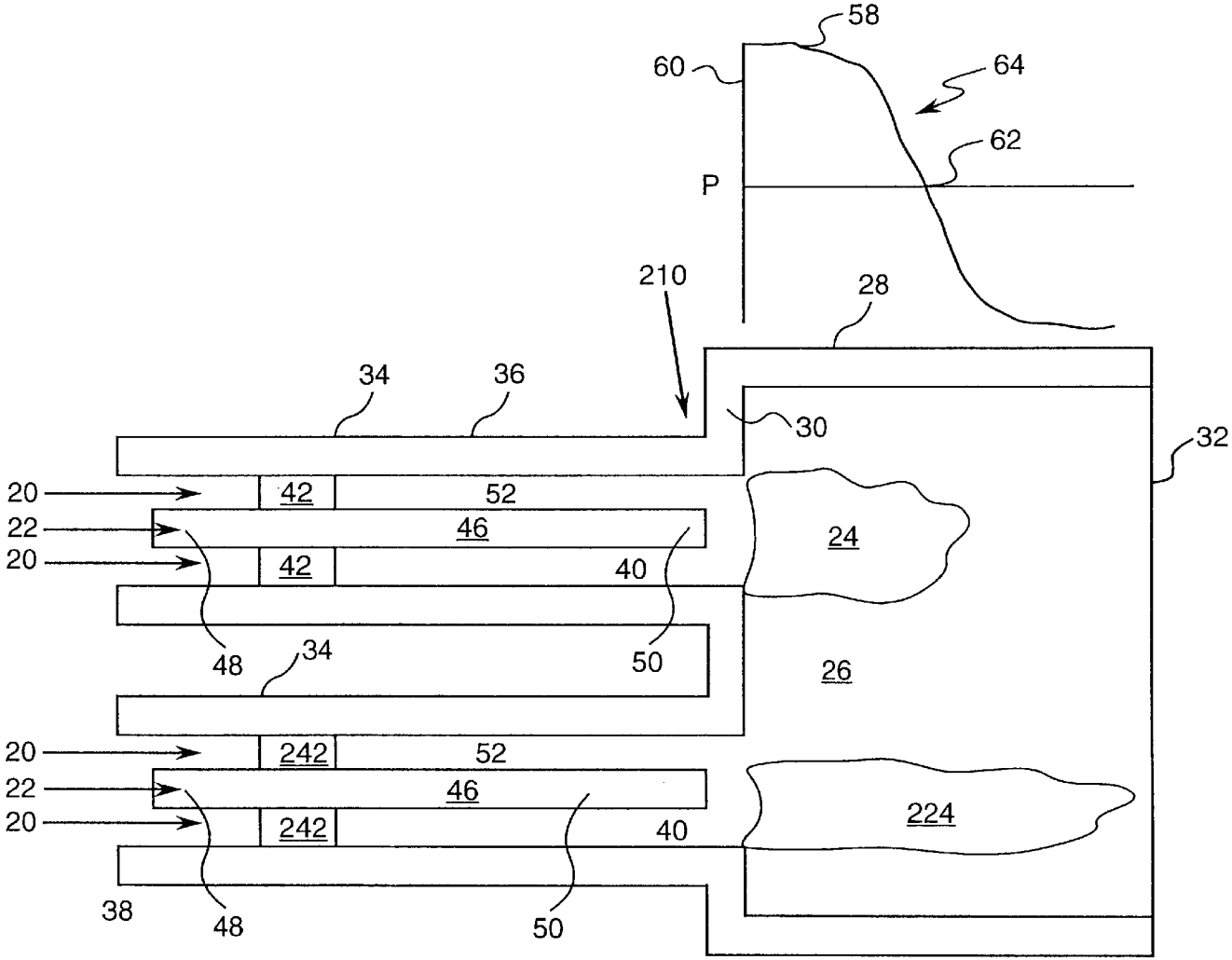
FIG. 3 is a schematic representation of a portion of an industrial gas turbine engine having a low NOx combustor in accordance with another embodiment of the present invention.

In accordance with another embodiment of the instant invention, a combustor 210 is shown in FIG. 3. As shown in FIG. 3, flame structure asymmetry is introduced within combustor 210 by axial distribution of at least a portion of flame structures 224. Through this asymmetric distribution of flame structures 224, at least a portion of the combustion taking place within combustion chamber 26 will be axially positioned closer to pressure node 62 so as to decouple the heat release from flame structures 224 from the maximum pressures located at dome end 30.

Asymmetry introduced within the flame structures 224 is created by manipulating the angle and profile of the swirl blades to have a smaller swirl angle within swirler 42. The result of manipulating the angle profile of swirler 42 is that flame structures 224 will be exposed to a significantly different aerodynamic flow pattern of the entering combustion air 20 then the premixers supporting non-manipulated flame structures 24 are exposed to. The smaller swirl angles of manipulated swirlers 242 support longer narrower flame structures 224 when compared with non-manipulated flame structures. In one embodiment of the instant invention swirlers 242 comprise a swirl angle that is in the range between about 15% to 50% smaller than the swirl angle of non-manipulated swirlers 42.

Figure 4:
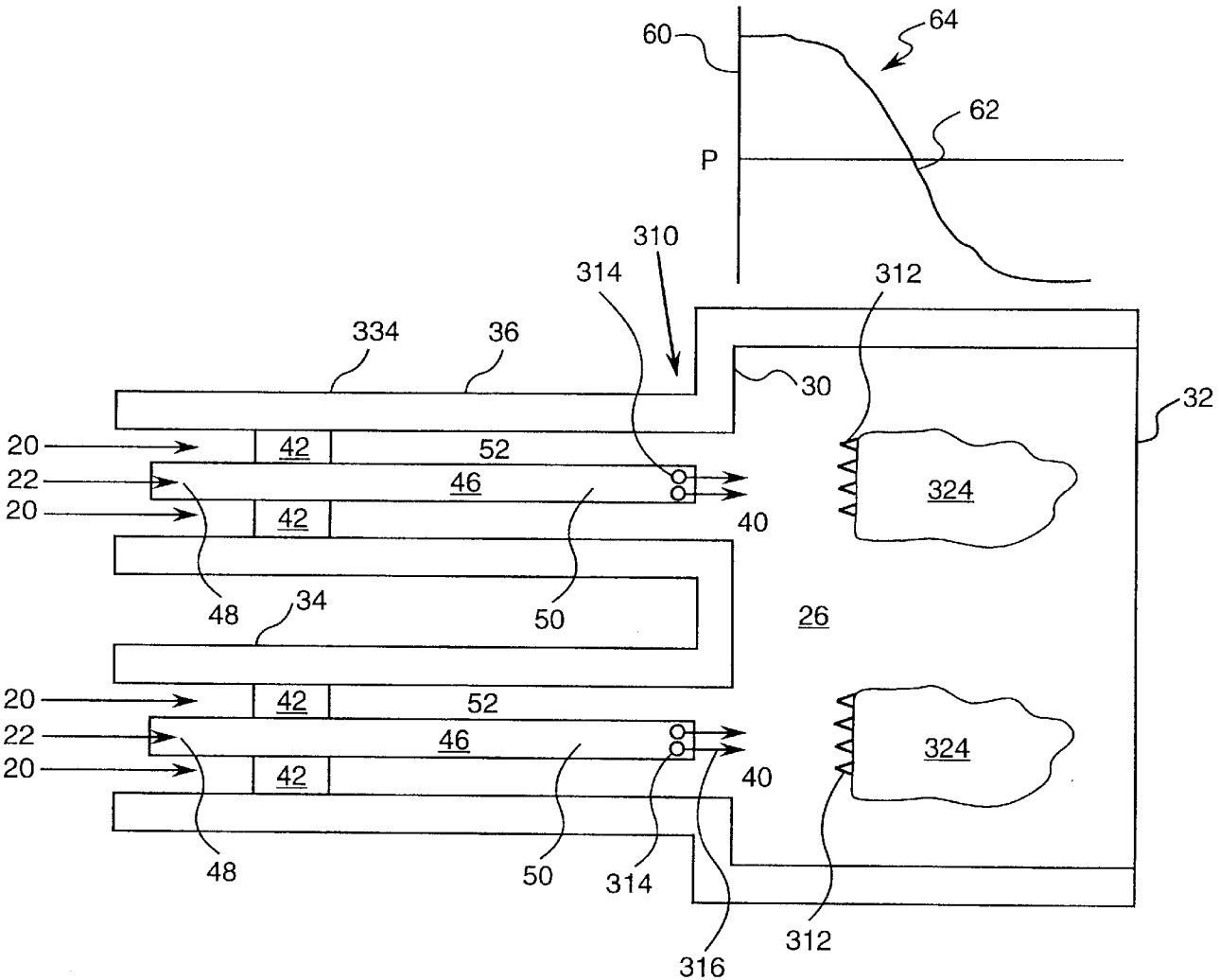
FIG. 4 is a schematic representation of a portion of an industrial gas turbine engine having a low NOx combustor in accordance with one embodiment of the present invention.

In accordance with another embodiment of the instant invention, combustor 310 is shown in FIG. 4. As shown in FIG. 4, flame structure 324 of each premixer 334 is anchored downstream of dome end 30. Through this axial distribution of flame structures 324 the combustion taking place within combustor 310 will be axially positioned proximate pressure node 62 so as to minimize Rayleigh's criteria so as to decouple the heat release from flame structures 324 with the maximum pressure fluctuations located with dome end 30.

In one embodiment of the instant invention, combustor 310 further comprises a plurality of flameholders 312 positioned axially downstream from dome end 30 proximate pressure node 62. Flameholders 312 may comprise any type of suitable flameholders including but not limited to gutters, v-gutters, rounded-nose gutters or jet curtain flameholders. Flame structures 324 anchor at flameholders 312 and accordingly flame structures 324 are axially positioned at or near pressure node 62 where pressure fluctuations are significantly reduced. Because the pressure fluctuations are reduced with respect to flame structures 324, Rayleigh's criteria is minimized and coupling between the pressure wave and the combustion wave is reduced.

In one embodiment of the instant invention, combustor 310 may further comprise at least one, and typically a plurality, of orifices 314 disposed within the downstream end 50 of each premixer 334. High velocity air 316 is directed through orifices 314 so as to quench the conventional anchoring location at downstream end 50 of center body 46 and at domd end 30 to ensure anchoring of flame structures 324 on flameholders 312 and not at dome end 30.

Figure 5:
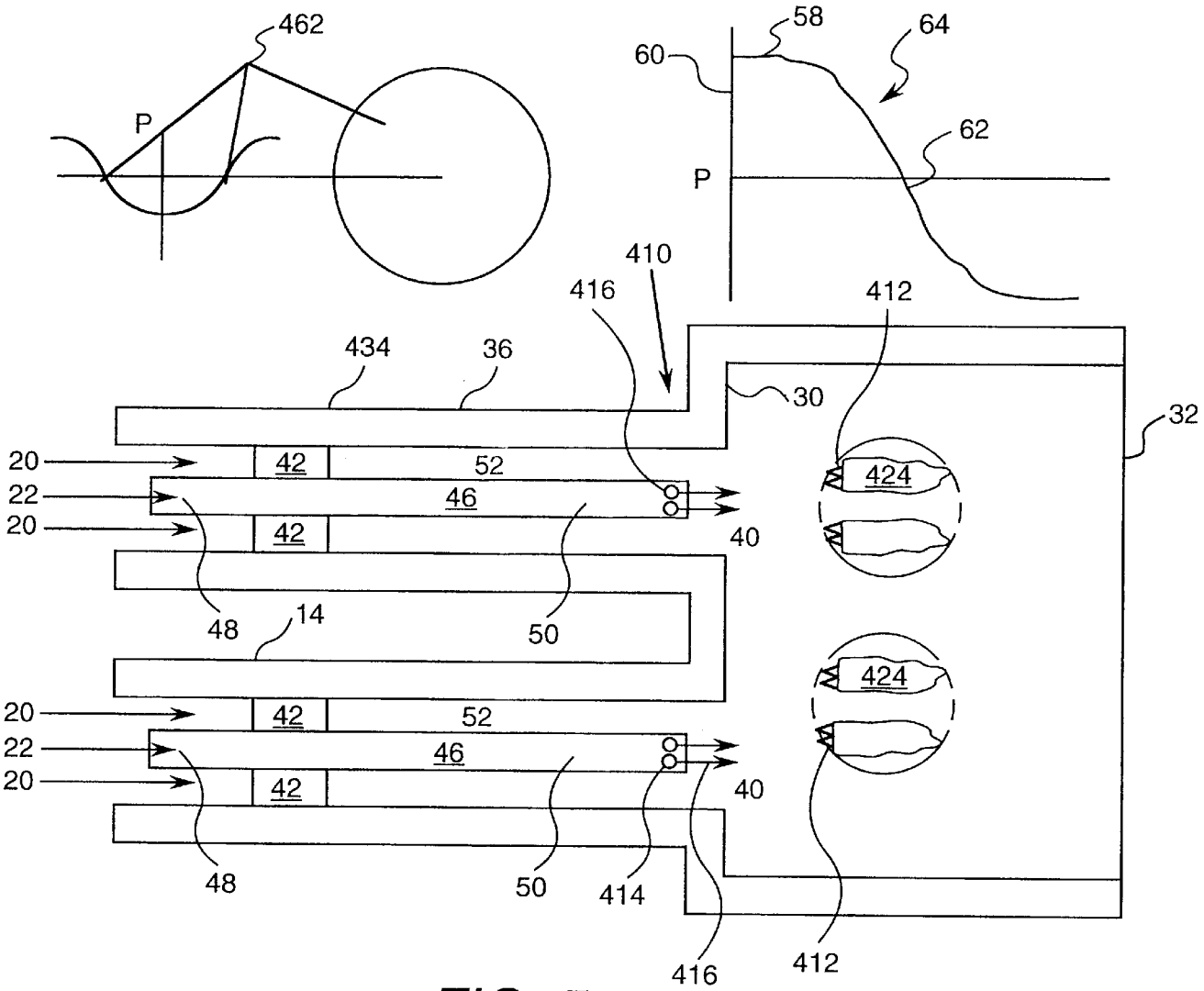
FIG. 5 is a schematic representation of a portion of an industrial gas turbine engine having a low Nox combustor in accordance with one embodiment of the present invention.

Another acoustic mode which has been observed in pre-mixed combustors is the fundamental transverse radial standing wave resonance, as shown in FIG. 5. Radial wave structures produce maximum pressure fluctuations at the center and outside diameter of combustion chamber 26, with a pressure node 462 of zero fluctuation at an intermediate radius. In one embodiment of the instant invention combustor 410 is configured such that the reaction zone 424 is concentrated at a toroidal shape centered about nodal circle 462. Because the pressure fluctuations are reduced with respect to flame structures 424, Rayleigh's criteria is minimized and coupling between the pressure wave and the combustion wave is reduced. If toroidal reaction zones 424 are also positioned to correspond to longitudinal pressure node 62, then each acoustic mode can be suppressed. Accordingly, flame 424 is both radially and longitudinally distributed for the suppression of these two nodes.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A combustor comprising:

an outer combustor casing defining a plurality of circumferentially adjoining combustion chambers, each combustion chamber comprising a dome at an upstream end and an outlet at a downstream end;

a plurality of pre-mixers joined to said combustor dome of each respective combustion chamber, said pre-mixers comprising a duct having an inlet at one end for receiving compressed air, an outlet at an opposite end disposed in flow communication with said combustion chamber and a swirler disposed in said duct adjacent said duct inlet for swirling air channeled therethrough; and a plurality of fuel injectors for injecting fuel into said pre-mixer ducts and for mixing with said air in said ducts for flow into said combustion chamber to generate combustion flames at said duct outlets;

wherein a portion of said pre-mixers comprise an altered flameholding capability so as to distribute said resulting combustion flames from said respective portion of said pre-mixers axially downstream with respect to a portion of non-altered pre-mixers to reduce the dynamic pressure amplitude of said combustion flames;

wherein said pre-mixers comprising an altered flameholding capability comprise at least one orifice for directing high velocity air to impinge upon said combustion flames so as to lift said respective combustion flames from said dome end and shift said combustion flames axially downstream.

2. A combustor, in accordance with claim 1, wherein the velocity of said high velocity air is great enough to overcome the flame propagation speed.

3. A combustor, in accordance with claim 1, wherein said high velocity air is supplied directly to said respective orifices from a high-pressure air source.

4. A combustor, in accordance with claim 3, wherein said high velocity air supplied from said high-pressure air source is manipulated so as to tune said combustion chamber for minimum combustion instability.

5. A combustor, in accordance with claim 1, wherein said high velocity air is supplied passively into said respective orifices by providing fluid communication between said respective orifices and a high-pressure region of a turbine engine.

6. A combustor, in accordance with claim 1, wherein said combustion flames are shifted axially downstream so as to be axially positioned proximate a pressure node source to minimize Rayleigh's Criteria.

* * * * *